US009301633B2

(12) United States Patent
Letney

(10) Patent No.: US 9,301,633 B2
(45) Date of Patent: Apr. 5, 2016

(54) UNITY HEART DEVICE

(71) Applicant: Michael James Letney, Tulsa, OK (US)

(72) Inventor: Michael James Letney, Tulsa, OK (US)

(73) Assignee: Michael James Letney, Tulsa, OK (US)

( * ) Notice: Subject to any disclaimer, the term of this patent is extended or adjusted under 35 U.S.C. 154(b) by 141 days.

(21) Appl. No.: 13/949,625

(22) Filed: Jul. 24, 2013

(65) Prior Publication Data

US 2014/0363589 A1 Dec. 11, 2014

Related U.S. Application Data

(63) Continuation-in-part of application No. 29/457,052, filed on Jun. 6, 2013, now Pat. No. Des. 715,684.

(51) Int. Cl.

| | |
|---|---|
| ***A47G 33/00*** | (2006.01) |
| ***B44F 3/00*** | (2006.01) |
| *B44C 5/00* | (2006.01) |

(52) U.S. Cl.

CPC . *A47G 33/00* (2013.01); *B44C 5/00* (2013.01); *B44C 5/005* (2013.01); *Y10T 29/49826* (2015.01); *Y10T 29/49963* (2015.01)

(58) Field of Classification Search

CPC ..... A47G 33/00; A47G 33/02; B44C 5/00; B44C 5/005; B44C 3/12; B44F 3/00

See application file for complete search history.

(56) References Cited

U.S. PATENT DOCUMENTS

| | | | | |
|---|---|---|---|---|
| 274,638 | A | 3/1883 | Mould | |
| 1,473,530 | A * | 11/1923 | Walrow | 446/487 |
| 1,695,307 | A * | 12/1928 | Wilson | 362/121 |
| 2,355,154 | A | 8/1944 | Goudreau | |
| 2,533,778 | A | 6/1946 | Eckhardt | |
| 5,390,510 | A | 2/1995 | Tirio-Cloonan | |
| D619,926 | S * | 7/2010 | Letney | D11/157 |
| 8,038,309 | B2 | 10/2011 | Yang | |
| 8,226,877 | B2 | 7/2012 | Fischer | |
| 8,418,344 | B1 | 4/2013 | Letney | |
| D686,385 | S | 7/2013 | Letney | |
| 2010/0012661 | A1 | 1/2010 | Chou | |
| 2010/0038057 | A1 | 2/2010 | Li et al. | |

OTHER PUBLICATIONS

Shopinspiration.com, "1-The Unity Cross", 2011, p. 1-2; Accessed at http://web.archive.org/web/20110607151852/http://shopinspiration.com/1-The-Unity-Cross-792119900301.htm.*

Angelia, "Living, Loving, Laughing", 2011, p. 1-4; http://youthinkyoucanblog.com/2011/02/10/a-wedding-post-the-sand-ceremony/.*

(Continued)

*Primary Examiner* — Mark Ruthkosky
*Assistant Examiner* — Julia L Rummel
(74) *Attorney, Agent, or Firm* — Head, Johnson & Kachigian, P.C.

(57) ABSTRACT

A multi-piece ceremonial sculpture and a method of assembly. The method of assembling the sculpture is to fasten a heart-shaped outer piece to a base by way of a peg and an indented hole. Once the outer piece has been secured, an inner piece will be inserted within the outer piece and securely fastened within. A topper pin is placed through aligned openings on the top of both the outer and inner pieces. Once assembled, the heart sculpture represents love, unity and commitment between two parties together in a union.

6 Claims, 7 Drawing Sheets

(56) References Cited

OTHER PUBLICATIONS

The Unity Sand Ceremony, "Announcing a Beautiful New Unity Sand Ceremony Collection", 2007, p. 1; Accessed on Jun. 11, 2015 at http://web.archive.org/web/20071214224428/http://www.unitysandceremony.net/2007/12/12/announcing-a-beautiful-new-unity-sand-ceremony-collection/.*

Hayes, C.; "Latest Bandsaw Box", 2005, p. 1-4, http://www.sawmillcreek.org/showthread.php?24737-Latest-Bandsaw-Box.*

* cited by examiner

UNITY HEART DEVICE

CROSS REFERENCE TO RELATED APPLICATIONS

The present application is a continuation-in-part of U.S. Design patent application Ser. No. 29/457,052 entitled "Unity Heart Device", filed Jun. 6, 2013, which is incorporated herein by reference in its entirety.

BACKGROUND OF THE INVENTION

1. Field of the Invention

The present invention is directed to a method of assembling a multi-piece ceremonial sculpture and to a multi-piece ceremonial sculpture. More specifically, the present invention is a method of assembling a ceremonial heart-shaped sculpture, that once assembled establishes a symbol of unity during a wedding or union ceremony.

2. Description of the Related Art

Various ceremonial rituals such as candles and other devices are commonly used to commemorate weddings, unions, or other various types of ceremonies. During a ceremony, two people in unison commence some sort of action such as lighting a candle, or filling a bottle with sand in order to show and celebrate their union.

Current existing art also includes the assembly of a cross-like sculpture during a ceremony to celebrate a union for example, see Applicant's Method of Assembling a Multi-Piece Sculpture (U.S. Pat. No. 8,418,344). An assembly of a heart-shaped sculpture is desired in the art and advantageous over the prior designs and commemorative rituals due to its unique nature and symbolism.

SUMMARY OF THE INVENTION

The present invention is directed to a method of assembly of a ceremonial multi-piece heart-shaped sculpture and to a multi-piece ceremonial sculpture.

During wedding, anniversary, and union ceremonies, it is becoming increasingly popular to celebrate with a unity ritual in order to symbolize the joining of two people, families, or business entities. There are many different types of rituals and devices that can be used during wedding ceremonies or other types of celebrations. A heart is often used as a symbol of love and unity during ceremonies. The unity heart device, when assembled during a wedding, union, or celebration ceremony creates and affirms the idea of love and unity between two people and/or families joining together.

In at least one preferred embodiment, the present invention provides a method of assembling a ceremonial multi-piece sculpture, composed of outer and inner components each shaped like hearts along with a sturdy base to secure the assembly together.

The outer piece is shaped like a heart and contains a peg at the lower point of the heart that firmly secures the outer piece to the solid/hollow base structure. The outer piece may represent a "Man" while the more intricate inner piece can represent a "Woman." The inner piece is also shaped like a heart and is firmly fitted within the outer piece. The outer piece has a recessed portion on the inside of its lower point in which the inner piece nests inside and is secured into place. A topper pin is inserted through an aligned opening in the upper points of each inner and outer pieces and further secures the two hearts together.

After the two hearts come together and the sculpture is assembled, it represents a shared commitment and unity between two people and acts as a daily reminder of those commitments.

DETAILED DESCRIPTION OF THE EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The embodiments contained herein provide for a method or process to assemble a ceremonial multi-piece sculpture as well as for a multi-piece ceremonial sculpture.

Figure 1:
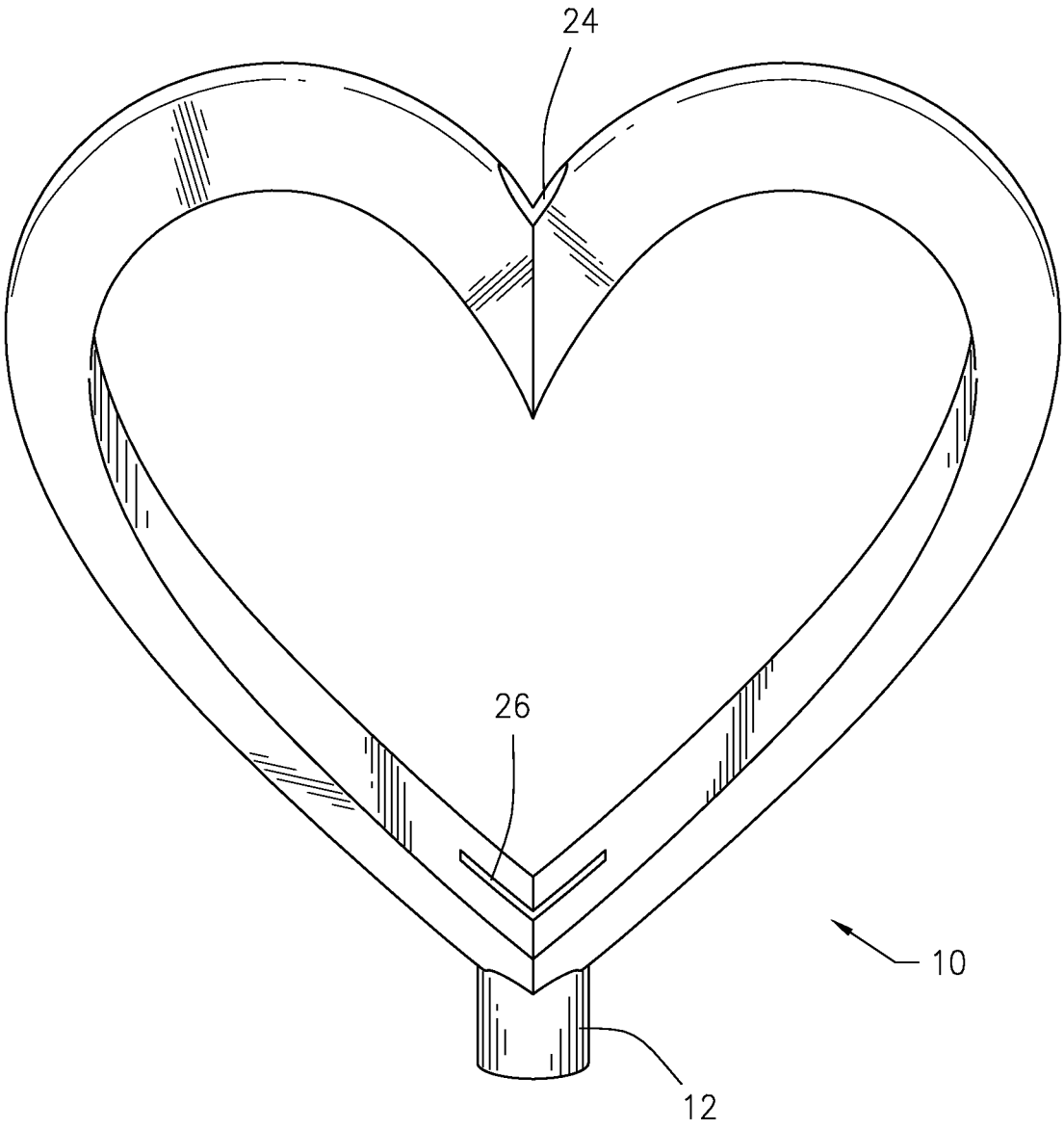
FIG. 1 illustrates a front view of an outer piece of a multi-piece sculpture constructed in accordance with the present invention.

As shown in FIG. 1, an outer piece 10 is shaped as an outline of a heart and may be brought to the ceremony by one of the parties. As a non-limiting example, this outer piece 10 would represent the "Man" within a wedding ceremony. The outer piece 10 may be composed of a sturdy plastic material and has a central open area so than an inner piece 22 (not shown in FIG. 1) can fit within. As shown in FIG. 1 the outer piece 10 contains a circular peg 12 which protrudes out of the bottom of the heart-shaped outer piece 10. A recessed portion 26 at the lower point of the heart provides a place for the inner piece 22 (not shown in FIG. 1) to securely sit. Also shown in FIG. 1 is a circular opening 24 for a topper pin 30 (not shown in FIG. 1) to insert into.

Figure 2:
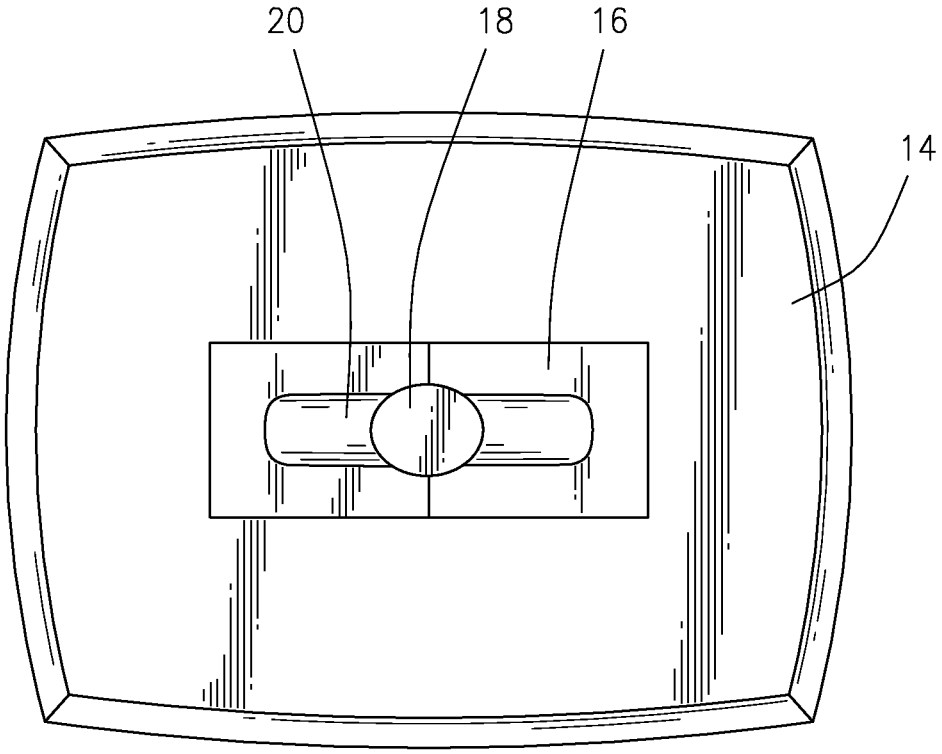
FIG. 2 illustrates a top view of a base piece of a multi-piece sculpture constructed in accordance with the present invention.
Figure 3:
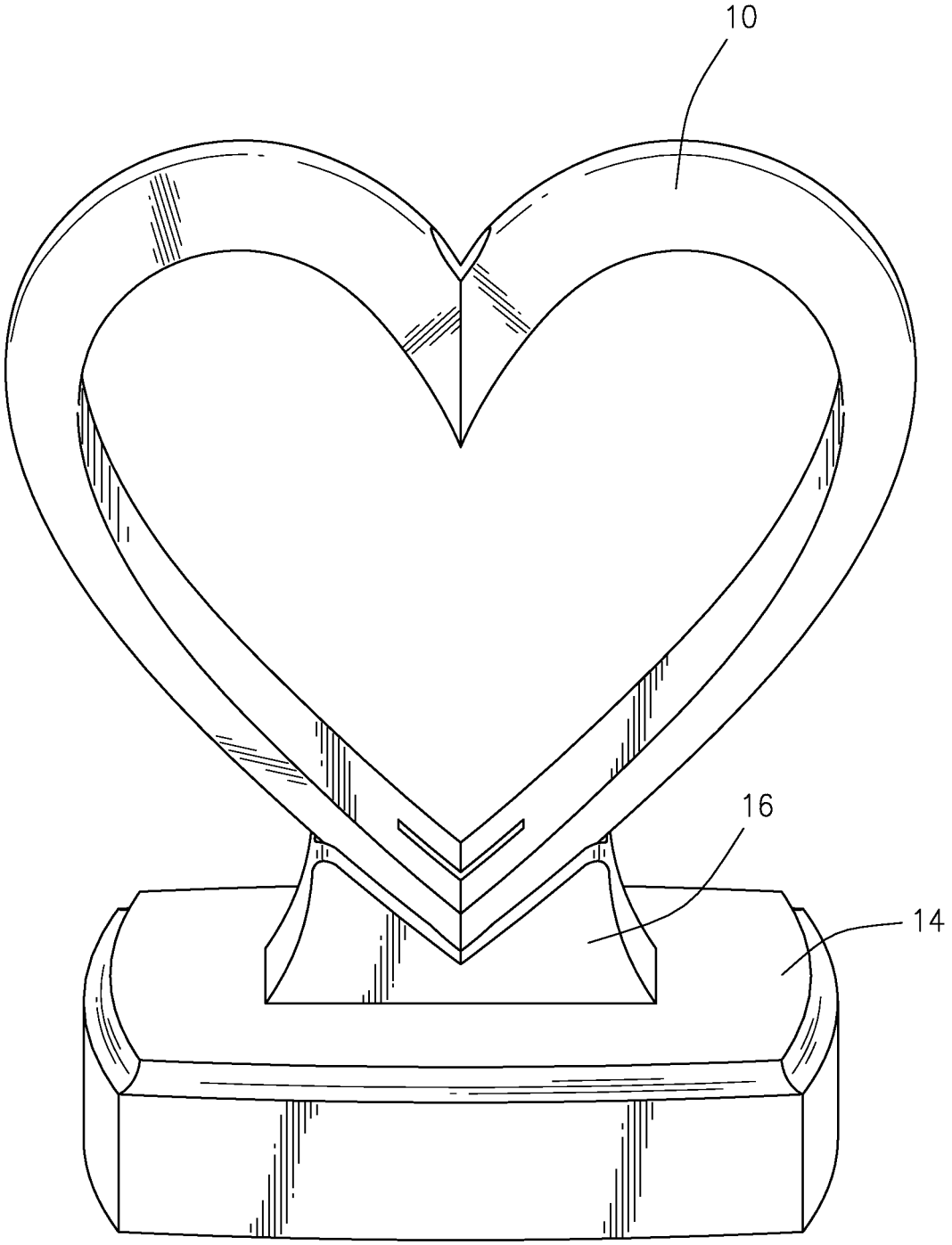
FIG. 3 illustrates a front view of an outer piece connected to the base of the multi-piece sculpture.

As shown in FIG. 2, a hollow (or solid) base 14 that contains a cradle 16 and an indented hole 18. The cradle 16 is a raised portion stemming from the base and serves to cradle and secure the outer piece 10. Cradle 16 contains a depression 20 for which outer piece 10 aligns with and securely rests in The cradle 16 centers around an indented hole 18 at the same position as and for alignment with circular peg 12 at the bottom of outer piece 10. This allows outer piece 10 to connect into the base 14. The outer piece 10 is positioned to firmly fit into the solid base 14 by inserting the peg 12 in the indented hole 18 of the solid/hollow base 14. FIG. 3, illustrates the outer piece 10 installed into base 14 by way of cradle 16.

Figure 4:
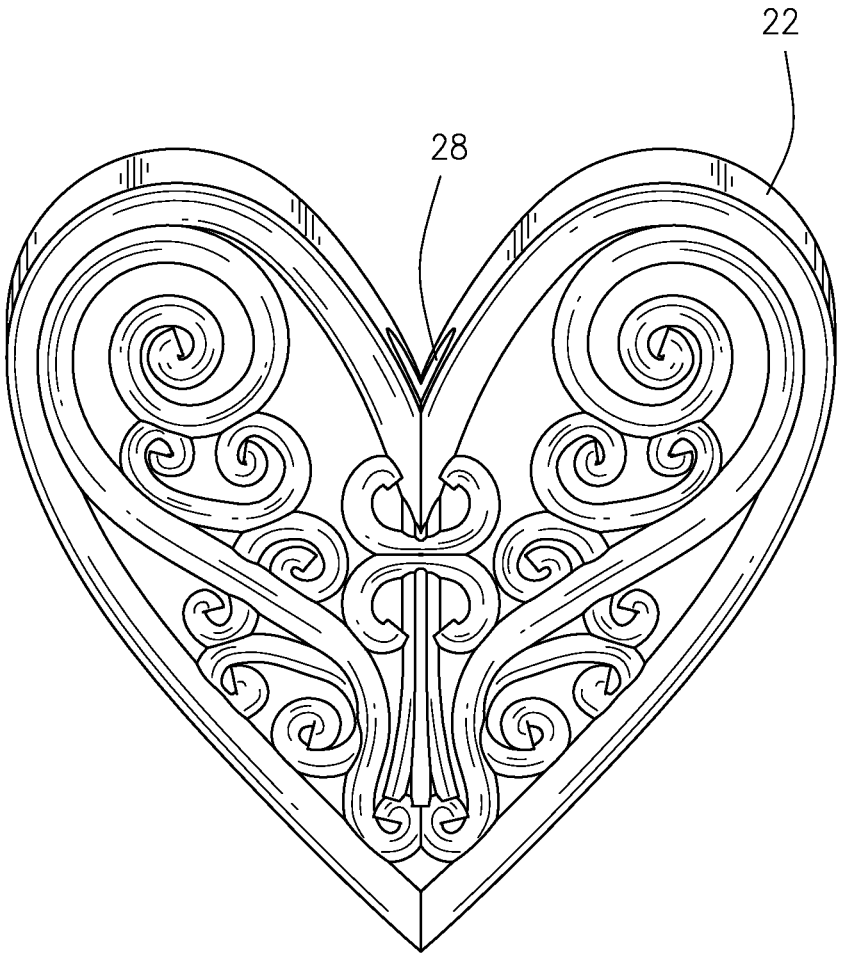
FIG. 4 illustrates a front view of an inner piece of the multi-piece sculpture.

As shown in FIG. 4, the inner piece 22 is intricately designed with scroll-like swirl designs, composed of a sturdy plastic material, while also shaped like a heart. The inner piece 22 may be brought to the ceremony by the other participating party, usually representing the "Woman" in a wedding ceremony. The inner piece 22 contains a circular opening on the top 28 which will align with the opening 24 of the outer piece 10 (not shown in FIG. 4) so that the inner piece 22 may fit firmly within the outer piece 10. The inner piece 22 will be inserted with the outer piece 10 (not shown in FIG. 4) by one party so that the opening 28 aligns with the outer piece opening 24.

Figure 5:
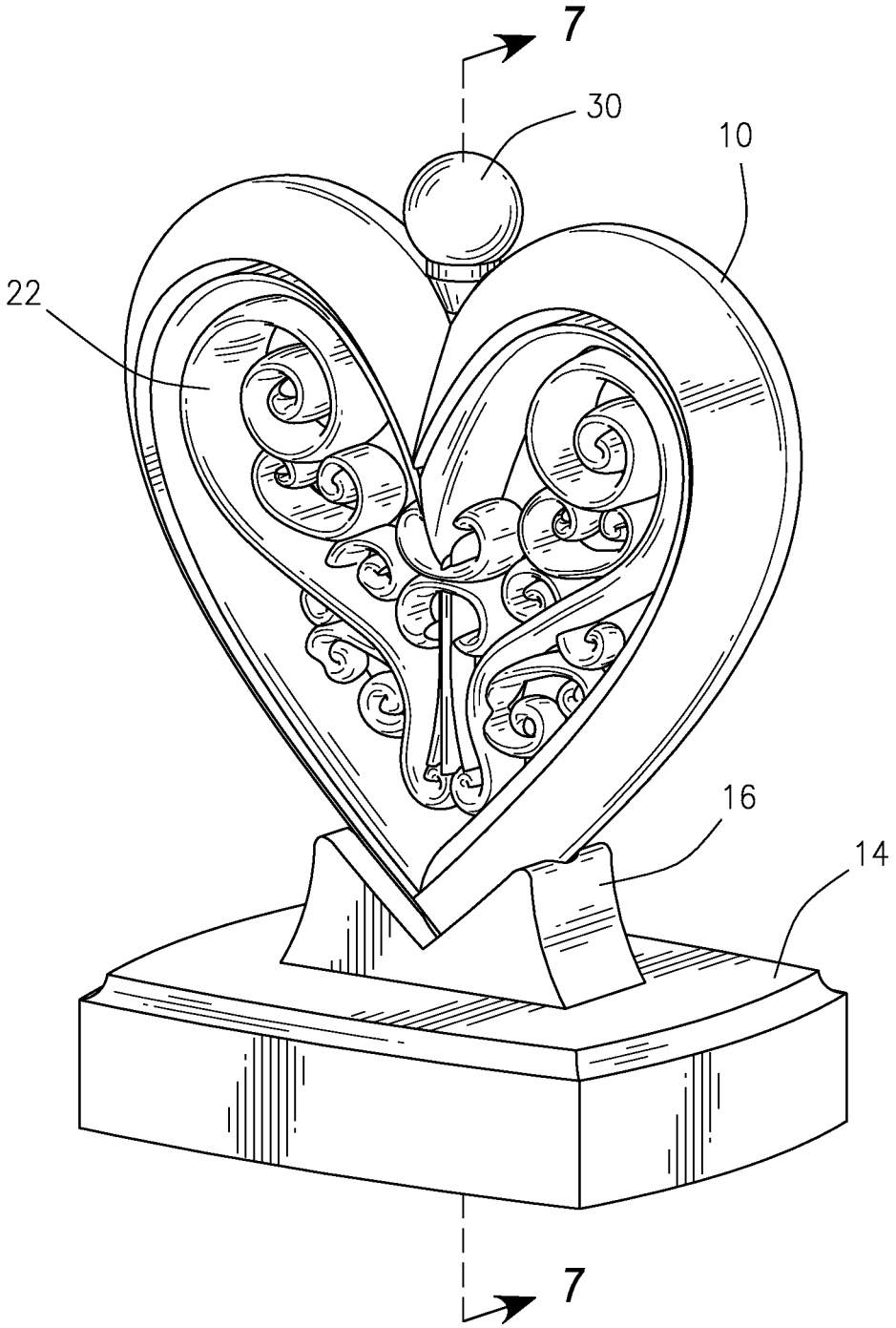
FIG. 5 illustrates a perspective view of the multi-piece sculpture after the completion of the assembly.
Figure 6:
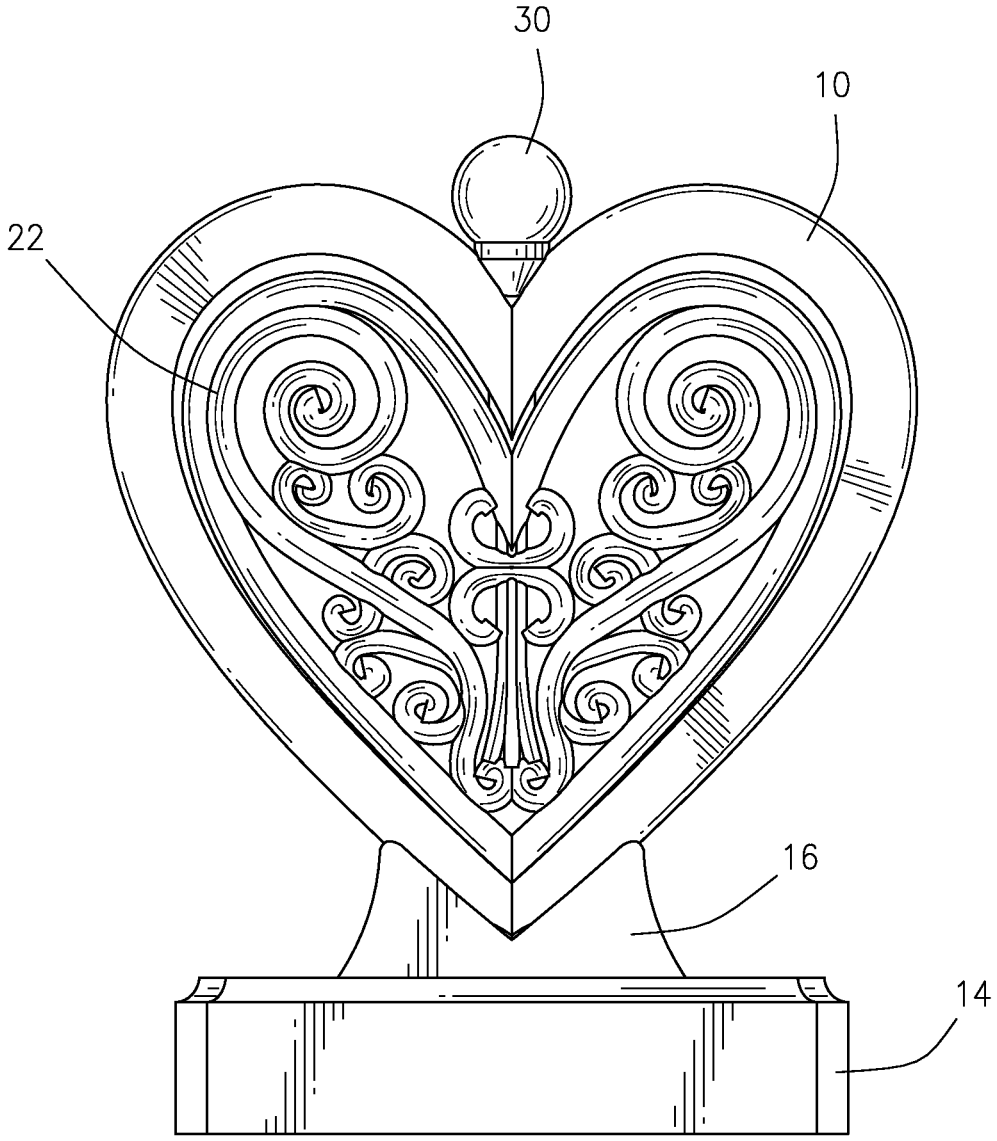
FIG. 6 illustrates a front view of the multi-piece sculpture after the completion of the assembly shown in FIG. 5.

Illustrated in FIG. 5, after the inner piece 22 has been inserted and firmly fitted into the outer piece 10, a topper pin 30 may be inserted through the top openings 24 and 28 in order to fasten the inner piece 22 and outer piece 10 together. Other types of toppers and pins may be used within the spirit and scope of the invention. FIG. 6 illustrates a front view of the completed assembly.

Figure 7:
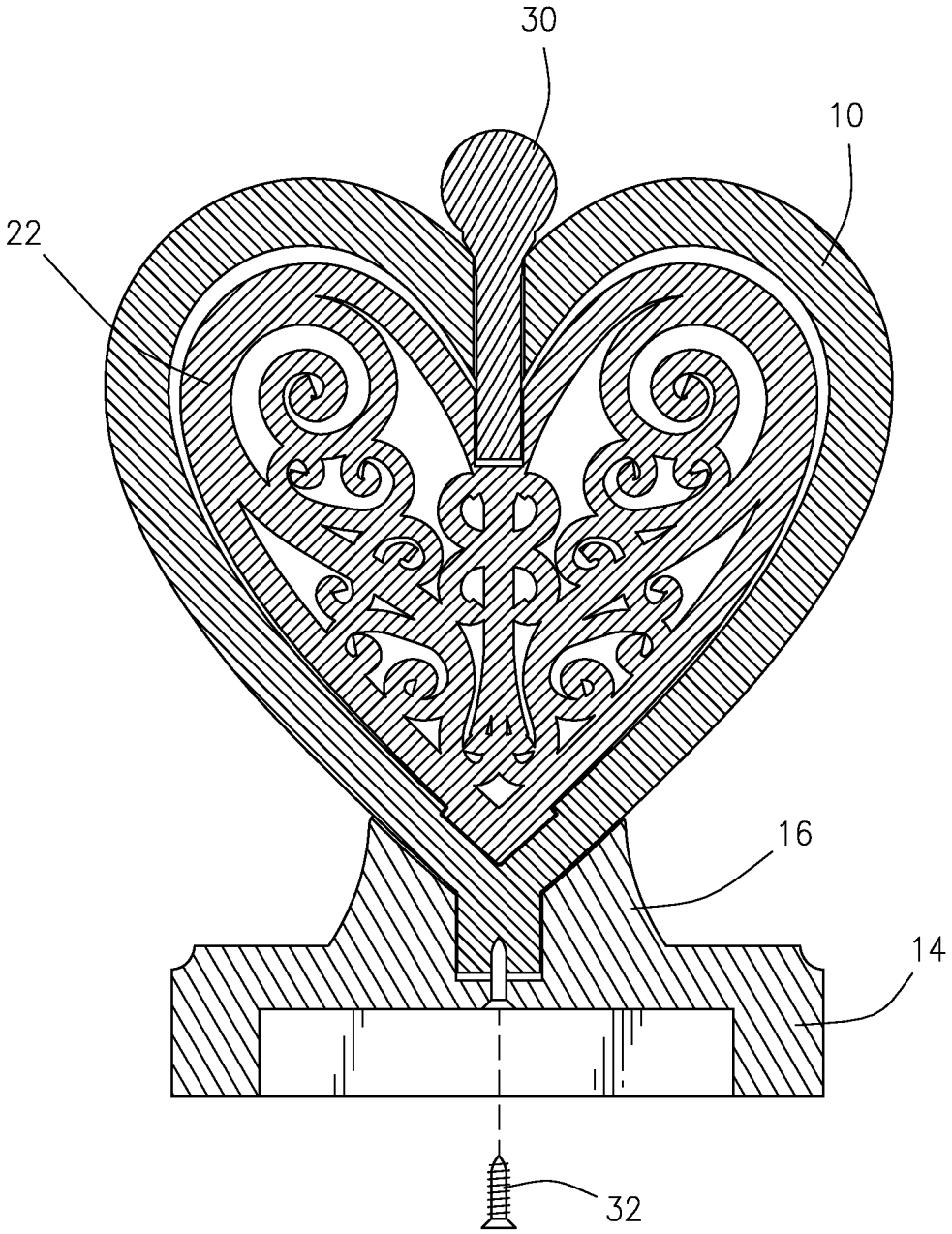
FIG. 7 illustrates a sectional view of the multi-piece sculpture assembly taken along section line 7-7 of FIG. 5.

FIG. 7 illustrates the sectional view of the assembled figure taken along sectional line 7-7 of FIG. 5, and highlights the option to insert a screw 32 through the bottom of the base 14. A party may turn the assembly over and insert the screw 32 into the bottom of the indented hole 18 of the base. The screw 32 enters through the base 14 and into the peg 12 at the bottom of the outer piece 10. The screw may fasten the heart-shaped outer piece 10 to the solid/hollow base 14 from the bottom of the base 14 platform.

What is claimed is:

1. A method of assembling a ceremonial multi-piece sculpture representational of a union and commitment in a ritual-based ceremony, which comprises the steps of:

inserting onto a base an outer piece having a front side and a back side, a heart-shaped exterior perimeter that includes an upper vertex and a lower vertex, and a central open area in the shape of a heart extending completely from the front side to the back side of the outer piece, the central open area being bordered by an inner edge of said outer piece, wherein said outer piece has a peg-shaped protrusion extending from its lower vertex into the base, said base has a lower portion with a planar upper surface and a cradle resting on top of the planar upper surface, the cradle having a vertex-shaped indentation, the angle of the vertex-shaped indication being substantially the same as the angle of the outer piece's lower vertex; and wherein the lower vertex of the outer piece is inserted into said vertex-shaped indentation;

inserting into the central open area of said heart-shaped outer piece through the front side or back side of the outer piece a heart-shaped inner piece having an exterior perimeter that is slightly smaller than the central open area of the outer piece and having an upper vertex, a lower vertex, and a chevron-shaped protrusion extending from and coextensive with the heart-shaped inner piece's lower vertex, wherein the chevron-shaped protrusion of said inner piece is inserted into a slot that is formed in the inner edge of said outer piece and adjacent the bottom of the central open area of said outer piece such that the inner piece is in planar alignment with the outer piece; and fastening the inner piece to the outer piece and completing said ceremonial multi-piece sculpture by inserting a topper pin through an opening in the upper vertex of said outer piece and into an opening in the upper vertex of said inner piece.

2. A method of assembling a ceremonial multi-piece sculpture as set forth in claim 1 wherein said heart-shaped outer piece is fastened with at least one screw extending from below the base up through the heart-shaped piece's peg-shaped protrusion.

3. A method of assembling a ceremonial multi-piece sculpture as set forth in claim 2 wherein said heart-shaped inner piece is inserted within said outer piece with openings of said outer and inner pieces aligned.

4. A method of assembling a ceremonial multi-piece sculpture as set forth in claim 1 wherein said inner piece includes scroll-like, swirl designs.

5. A ceremonial multi-piece sculpture assembly representational of a union and commitment in a ritual-based ceremony, which comprises:

an outer piece having a front side and a back side, a heart-shaped exterior perimeter that includes an upper vertex and a lower vertex, a peg-shaped protrusion that extends from the lower vertex, a central open area in the shape of a heart extending completely from the front side to the back side of the outer piece, the central open area being bordered by an inner edge of said outer piece, and a slot that is formed into the inner edge of said outer piece and adjacent the bottom of the central open area;

a heart-shaped inner piece having an exterior perimeter that is slightly smaller than the central open area of the outer piece and having an upper vertex, a lower vertex, and a chevron-shaped protrusion extending from and coextensive with the heart-shaped inner piece's lower vertex; and a base having a lower portion with a planar upper surface and a cradle resting on top of the planar upper surface, the cradle having a vertex-shaped indentation, the angle of the vertex-shaped indication being substantially the same as the angle of the outer piece's lower vertex, wherein a peg-shaped hole extends through the cradle and into the lower portion of the base;

wherein the peg-shaped protrusion extending from the lower vertex of the outer heart-shaped piece is securely fastened into the peg-shaped hole in the base;

wherein the inner piece is positioned inside of the central open area of the outer piece such that the inner piece's chevron-shaped protrusion rests inside of the slot formed in the inner edge of the outer piece and such that the inner piece is in planar alignment with the outer piece; and wherein a topper pin fastener extends through an opening in said upper vertex of said outer piece and into an opening in said upper vertex of said inner piece such that the inner piece is fastened to the outer piece.

6. A ceremonial multi-piece sculpture assembly as set forth in claim 5 wherein said heart-shaped outer piece is fastened with screws extending from below the base up through the heart-shaped piece's peg-shaped protrusion.

* * * * *